US010375490B2

(12) United States Patent
Jensen et al.

(10) Patent No.: US 10,375,490 B2
(45) Date of Patent: Aug. 6, 2019

(54) BINAURAL BEAMFORMER FILTERING UNIT, A HEARING SYSTEM AND A HEARING DEVICE

(71) Applicant: Oticon A/S, Smørum (DK)

(72) Inventors: Jesper Jensen, Smørum (DK); Meng Guo, Smørum (DK); Richard Heusdens, Delft (NL); Richard Hendriks, Delft (NL); Jamal Amini, Delft (NL)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 15/725,067

(22) Filed: Oct. 4, 2017

(65) Prior Publication Data

US 2018/0098160 A1 Apr. 5, 2018

(30) Foreign Application Priority Data

Oct. 5, 2016 (EP) ..... 16192501

(51) Int. Cl.
*H04R 25/00* (2006.01)

(52) U.S. Cl.
CPC ..... *H04R 25/552* (2013.01); *H04R 25/405* (2013.01); *H04R 25/407* (2013.01);
(Continued)

(58) Field of Classification Search
CPC .. H04R 25/552; H04R 25/405; H04R 25/407; H04R 25/505; H04R 25/554; H04R 25/353; H04R 2225/41; H04R 2430/03
(Continued)

(56) References Cited

U.S. PATENT DOCUMENTS

2016/0234610 A1 8/2016 Jensen et al.

FOREIGN PATENT DOCUMENTS

EP 2 701 145 A1 2/2014
EP 2 882 203 A1 6/2015

OTHER PUBLICATIONS

Amini et al., "On the Impact of Quantization on Binaural MVDR Beamforming", ITG-Fachbericht 267: Speech Communication, Oct. 7, 2016, XP055338686, pp. 160-164.

(Continued)

*Primary Examiner* — Vivian C Chin
*Assistant Examiner* — Douglas J Suthers
(74) *Attorney, Agent, or Firm* — Birch, Stewart, Kolasch & Birch, LLP

(57) ABSTRACT

The application relates to a hearing device adapted for being located at or in a first ear of a user, or to be fully or partially implanted in the head at a first ear of a user, the hearing device comprising a first input transducer for converting a first input sound signal from a sound field around the user at a first location, the first location being a location of the first input transducer, to a first electric input signal, the sound field comprising a mixture of a target sound from a target sound source and possible acoustic noise;

a transceiver unit configured to receive a first quantized electric input signal via a communication link, the first quantized electric input signal being representative of the sound field around the user at a second location, the first quantized electric input signal comprising quantization noise due to a specific quantization scheme;

a beamformer filtering unit adapted to receive said first electric input signal and said quantized electric input signal and to determine beamformer filtering weights, which, when applied to said first electric input signal and said quantized electric input signal, provide a beamformed signal, and (Continued)

a control unit adapted to control the beamformer filtering unit, wherein the control unit is configured to control the beamformer filtering unit taking account of said quantization noise. The invention may e.g. be used for the hearing aids and other portable electronic devices with limited power capacity.

17 Claims, 7 Drawing Sheets

(52) U.S. Cl.
CPC ..... *H04R 25/505* (2013.01); *H04R 25/554* (2013.01); *H04R 25/353* (2013.01); *H04R 2225/41* (2013.01); *H04R 2430/03* (2013.01)

(58) Field of Classification Search
USPC ..... 381/23.1
See application file for complete search history.

(56) References Cited

OTHER PUBLICATIONS

Cornelis et al., "A QRD-RLS Based Frequency Domain Multichannel Wiener Filter Algorithm for Noise Reduction in Hearing Aids", 18th European Signal Processing Conference (EUSIPCO-2010), Aalborg, Denmark, Aug. 23-27, 2010, pp. 1953-1957.

Srinivasan et al., "Beamforming under Quantization Errors in Wireless Binaural Hearing Aids", XP-002547217, vol. 2008, total of 11 pages.

Srinivasan et al., "Effect of quantization on beamforming in binaural hearing aids", XP-002547216, total of 4 pages.

Doclo et al., "Acoustic beamforming for hearing aid applications", 2010, pp. 1-34.

Lipshitz et al., "Quantization and dither: A theoretical survey", J. Audio Eng. Soc., vol. 40, No. 5, May 1992, pp. 355-375.

BINAURAL BEAMFORMER FILTERING UNIT, A HEARING SYSTEM AND A HEARING DEVICE

SUMMARY

The present disclosure relates to beamforming for spatially filtering an electric input signal representing sound in an environment.

Hearing devices, e.g. hearing aids, such as hearing aids involving digital signal processing of an electric input signal representing sound in its environment, are e.g. designed to help hearing impaired people to compensate their hearing loss. Among other things, they aim to improve the intelligibility of speech, captured by one or multiple microphones in the presence of environmental noise. To do so, they employ beamforming techniques, i.e. signal processing techniques which combine microphone signal to enhance the signal of interest (e.g. speech). A binaural hearing system consists of two hearing devices (e.g. hearing aids) located at left and right ears of a user. At least in some modes of operation, the left and right hearing devices may collaborate through a wired or wireless interaural transmission channel. Binaural hearing systems enable the construction of binaural beamformers using the interaural transmission channel to transmit a microphone signal (or a part thereof) from one hearing device to the other (e.g. left to right and/or right to left). A given hearing device receiving one or more microphone signal(s) from the other hearing device can then use the received microphone signal(s) in its local beamforming process, thereby increasing the number of microphone inputs to the beamformer (e.g. from one to two, or from two to three or from two to four (if two microphone signals are received (e.g. exchanged)). The advantage of this is potentially more efficient noise reduction. Binaural beamformes are state-of-the-art and have been described in the literature, but have (to the best of our knowledge) not yet been used in commercial products.

Multi-microphone noise reduction algorithms in binaural hearing aids which cooperate through a wireless communication link have the potential to become of great importance in future hearing aid systems. However, limited transmission capacity of such devices necessitates the data compression of signals transmitted from one hearing aid to the contralateral one. The limited transmission capacity may e.g. result in limited bandwidth (bitrate) of the communications link. The limitations may e.g. be due to the portability of such device, their limited space, and hence limited power capacity, e.g. battery capacity.

In the prior art, binaural beamformers for hearing aids are typically artificially constructed. It is assumed that a microphone signal from one hearing aid can be transmitted instantaneously and without error to the other. In practice, however, microphone signals must be quantized before transmission. Quantization introduces noise, which cannot be avoided. Prior art binaural beamforming systems ignore the presence of the quantization noise. If used in practice, such systems would perform poorly. It is hence an advantage to take into account the presence of the quantization noise when designing binaural beamformers.

A Hearing Device:

In an aspect of the present application, a hearing device adapted for being located at or in a first ear of a user, or to be fully or partially implanted in the head at a first ear of a user is provided. The hearing device comprises a first input transducer for converting a first input sound signal from a sound field around the user at a first location, the first location being a location of the first input transducer, to a first electric input signal, the sound field comprising a mixture of a target sound from a target sound source and possible acoustic noise;

a transceiver unit configured to receive a first quantized electric input signal via a communication link, the first quantized electric input signal being representative of the sound field around the user at a second location, the first quantized electric input signal comprising quantization noise due to a specific quantization scheme;

a beamformer filtering unit adapted to receive said first electric input signal and said quantized electric input signal and to determine beamformer filtering weights, which, when applied to said first electric input signal and said quantized electric input signal, provide a beamformed signal, and a control unit adapted to control the beamformer filtering unit.

The control unit is configured to control the beamformer filtering unit taking account of said quantization noise, e.g. by determining said beamformer filtering weights in dependence of said quantization noise.

Thereby an improved hearing device is provided.

The first quantized electric input signal received via the communication link may be a digitized signal in the time domain or a number of digitized sub-band signals, each representing quantized signals in a time-frequency representation.

The sub-band signals of the first quantized electric signal may be complex signals comprising a magnitude part and a phase part, which may be quantized individually (e.g. according to identical or different quantization schemes). Higher order quantization schemes, e.g. vector quantization (VQ), may also be used (e.g. to provide a more efficient quantization).

In an embodiment, the control unit is configured to control the beamformer filtering unit taking account of said quantization noise based on knowledge of the specific quantization scheme. In an embodiment, the control unit is configured to receive an information signal indicating the specific quantization scheme. In an embodiment, the control unit is adapted to a specific quantization scheme. In an embodiment, the control unit comprises a memory unit comprising a number of different possible quantization schemes (and e.g. corresponding noise covariance matrices for the configuration of the hearing aid in question). In an embodiment, the control unit is configured to select the specific quantization scheme among said number of (known) quantization schemes. In an embodiment, the control unit is configured to select the quantization scheme in dependence of the input signal (e.g. it's bandwidth), a battery status (e.g. a rest capacity), an available link bandwidth, etc. In an embodiment, the control unit is configured to select the specific quantization scheme among said number of quantization schemes based on the minimization of a cost function.

In an embodiment, the quantization is due to A/D conversion and/or compression. In the present context, the quantization is typically performed on a (already) digitized signal.

In an embodiment, the beamformer filtering weights are determined depending on a look vector and a noise covariance matrix.

In an embodiment, the noise covariance matrix $\overline{C}_e$ comprises an acoustic component $\overline{C}_q$ and a quantization component $\overline{C}_q$: $\overline{C}_e=\overline{C}_v+\overline{C}_q$, where $\overline{C}_v$ is a contribution from acoustic noise, and $\overline{C}_q$ is a contribution from the quantization error. The quantization component $\overline{C}_q$ is a function of the applied quantization scheme (e.g. a uniform quantization scheme, such as a mid-riser or a mid-tread quantization scheme, with a specific mapping function), which should be agreed on, e.g. exchanged between devices (or fixed). In an embodiment, the noise covariance matrix of the acoustic part $\overline{C}_v$ is known in advance (at least except a scaling factor $\lambda$). The scaling factor $\lambda$ may e.g. be determined by the hearing aid during use (e.g. by a level detector, e.g. in combination with a voice activity detector, to be able to estimate a noise level, during absence of speech). In other words, the resulting covariance matrix (or its contributing elements) for a given quantization scheme (and a given distribution of acoustic noise) may be known in advance, and the relevant parameters stored in the hearing device (e.g. in a memory accessible to the signal processor). In an embodiment, the noise covariance matrix elements for a number of different distributions of acoustic noise and a number of different quantization schemes are stored in or accessible to the hearing device during use.

In an embodiment, the beamformer filtering unit is a minimum variance distortionless response (MVDR) beamformer.

The hearing device may comprise a memory unit comprising a number of different possible quantization schemes. The control unit may be configured to select the specific quantization scheme among said number of different quantization schemes. The memory may also comprise information about different acoustic noise distributions, e.g. noise covariance matrix elements for such noise distributions, e.g. for an isotropic distribution.

The control unit may be configured to select the quantization scheme in dependence of one or more of the input signal, a battery status, and an available link bandwidth.

The control unit may be configured to receive information about said specific quantization scheme from another device, e.g. another hearing device, e.g. a contra-lateral hearing device of a binaural hearing aid system. The information about a specific quantization scheme may comprise its distribution and/or variance.

The number of different possible quantization schemes may comprise a mid-tread and/or a mid-rise quantization scheme.

The transceiver unit may comprise antenna and transceiver circuitry configured to establish a wireless communication link to/from another device, e.g. another hearing device, to allow the exchange of quantized electric input signals and information of the specific quantization scheme with the other device via the wireless communication link.

The hearing device may comprise first and second input transducers for converting respective first and second input sound signals from said sound field around the user to first and second digitized electric input signals, respectively. The hearing device may be configured to quantize at least one of the first and second digitized electric input signals to at least one quantized electric signal and to transmit the quantized electric signal to another device, e.g. another hearing device, via the communication link (possibly via a third intermediate (auxiliary device, e.g. a smartphone or the like). The hearing device may be configured to quantize the first and second digitized electric input signals to first and second quantized electric signals and to transmit the quantized electric signals to another device, e.g. another hearing device, via the communication link (possibly via a third intermediate (auxiliary device).

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound.

The hearing device comprises a beamformer filtering unit (e.g. a directional microphone system) adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates (e.g. identify a direction of arrival, DoA). This can be achieved in various different ways as e.g. described in the prior art.

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by a transmitter and antenna and transceiver circuitry of the hearing device can be of any type. In an embodiment, the wireless link is used under power constraints, e.g. in that the hearing device comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation).

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits, or 1 to 48 bits, e.g. 24 bits. A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing assistance device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In an embodiment, the number of detectors comprises a level detector for estimating a current level of a signal of the forward path. In an embodiment, the predefined criterion comprises whether the current level of a signal of the forward path is above or below a given (L-)threshold value.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing assistance device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic;

b) the current acoustic situation (input level, feedback, etc.), and c) the current mode or state of the user (movement, temperature, etc.);

d) the current mode or state of the hearing assistance device (program selected, time elapsed since last user interaction, etc.) and/or of another device in communication with the hearing device.

In an embodiment, the hearing device further comprises other relevant functionality for the application in question, e.g. compression, feedback cancellation, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof. In an embodiment, the hearing device is or comprises a hearing aid.

Use:

In an aspect, use of a hearing device as described above, in the 'detailed description of embodiments' and in the claims, is moreover provided. In an embodiment, use is provided in a system comprising audio distribution, e.g. a system comprising a microphone and a loudspeaker. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is another hearing device. In an embodiment, the hearing system comprises two hearing devices adapted to implement a binaural hearing system, e.g. a binaural hearing aid system.

Definitions:

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

Embodiments of the disclosure may e.g. be useful in applications such as hearing aids and other portable electronic devices with limited power capacity.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
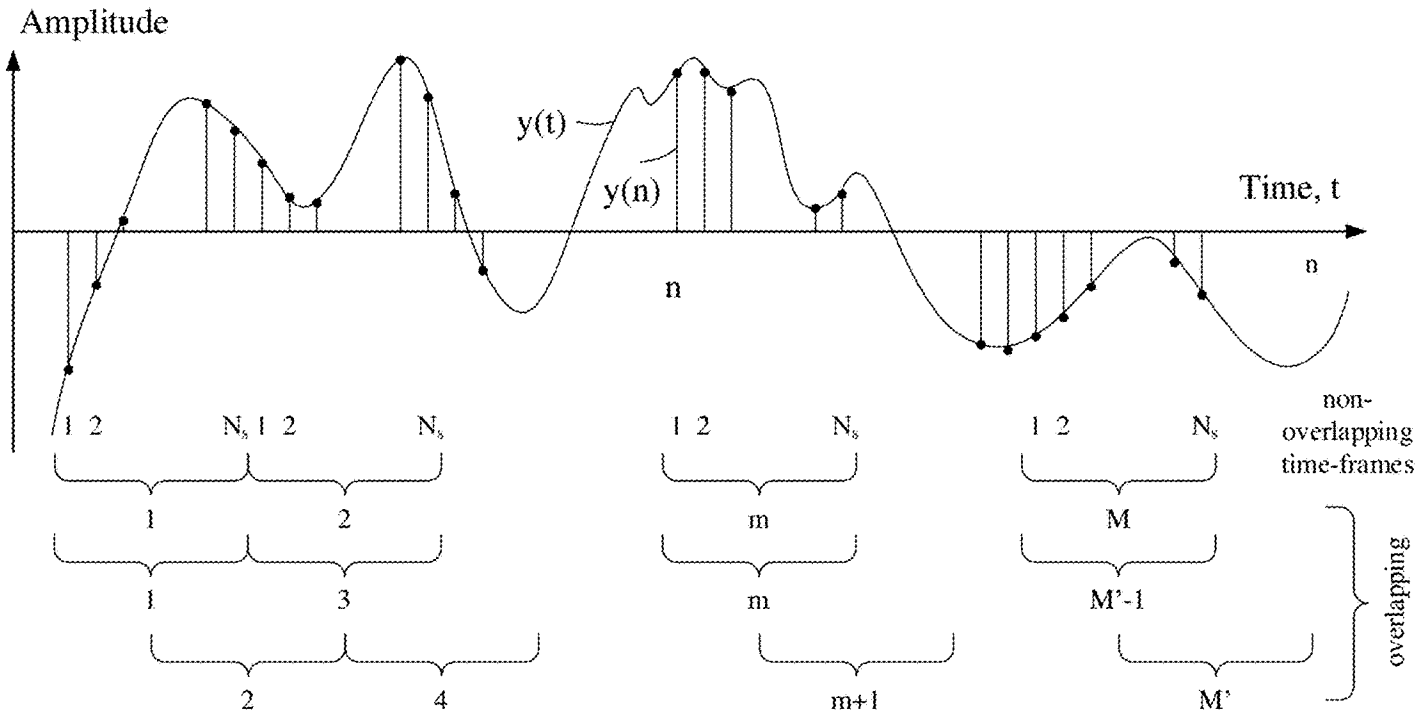
FIG. 1A schematically shows a time variant analogue signal (Amplitude vs time) and its digitization in samples, the samples being arranged in a number of time frames, each comprising a number $N_s$ of samples.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

The present application deals with the impact of quantization as a data compression scheme on the performance of multi-microphone noise reduction algorithms, e.g. beamformers, such as binaural beamformers. The term 'beamforming' is used in the present disclosure to indicate a spatial filtering of at least two sound signals to provide a beamformed signal. The term 'binaural beamforming' is in the present disclosure taken to mean beamforming based on sound signals received by at least one input transducer located at a left ear as well as at least one input transducer located at a right ear of the user. In the example below, a binaural minimum variance distortionless response (BMVDR) beamformer is used as an illustration. Alternatively other beamformers could be used. The minimum variance distortionless response (MVDR) beamformer is an example of a linearly constrained minimum variance (LCMV) beamformer. Other beamformers from this group than the MVDR beamformer may be used. Other binaural beamformers than a binaural LCMV beamformer may be used, e.g. based on a multi-channel Wiener filter (BMWF) beamformer. In an embodiment, a quantization-aware beamforming scheme, which uses a modified cross power spectral density (CPSD) of the system noise including the quantization noise (QN), is proposed.

Hearing aid devices are designed to help hearing-impaired people to compensate their hearing loss. Among other things, they aim to improve the intelligibility of speech, captured by one or multiple microphones in the presence of environmental noise. A binaural hearing aid system consists of two hearing aids that potentially collaborate through a wireless link. Using collaborating hearing aids can help to preserve the spatial binaural cues, which may be distorted using traditional methods, and may increase the amount of noise suppression. This can be achieved by means of multi-microphone noise reduction algorithms, which generally lead to better speech intelligibility than the single-channel approaches. An example of a binaural multi-microphone noise reduction algorithm is the binaural minimum variance distortionless response (BMVDR) beamformer) (cf. e.g. [Haykin & Liu, 2010]), which is a special case of binaural linearly constrained minimum variance (BLCMV)-based methods. The BMVDR consists of two separate MVDR beamformers which try to estimate distortionless versions of the desired speech signal at both left-sided and right-sided hearing aids while suppressing the environmental noise and maintaining the spatial cues of the target signal.

Using binaural algorithms requires that the signals recorded at one hearing aid are transmitted to the contralateral hearing aid through a wireless link. Due to the limited transmission capacity, it is necessary to apply data compression to the signals to be transmitted. This implies that additional noise due to data compression (quantization) is added to the microphone signals before transmission. Typically, binaural beamformers do not take this additional compression noise into account. In [Srinivasan et al., 2008], one binaural noise reduction scheme based on the generalized sidelobe canceller (GSC) beamformer under quantization errors was proposed. However, the quantization scheme used in [Srinivasan et al., 2008] assumes that the acoustic scene consists of stationary point sources, which is not realistic in practice. The target signal typically is a non-stationary speech source. Moreover, the far field scenario assumed in [Srinivasan et al., 2008] cannot support the real and practical analysis of the beamforming performance.

The present disclosure deals with the impact of quantization as a data compression approach on the performance of binaural beamforming. A BMVDR beamformer is used as an illustration, but the findings can easily be applied to other binaural algorithms. Optimal beamformers rely on the statistics of all noise sources (e.g. based on estimation of noise covariance matrices), including the quantization noise (QN). Fortunately, the QN statistics are readily available at the transmitting hearing aids (prior knowledge). We propose a binaural scheme based on a modified noise cross-power spectral density (CPSD) matrix including the QN in order to take into account the QN. To do so, in embodiments of the disclosure, we introduce two assumptions:

1) the QN is uncorrelated across microphones, and 2) the QN and the environmental noise are uncorrelated.

The validity of these assumptions depends on the used bit-rate as well as the exact scenario. Under low bit-rate conditions, it can be shown that using subtractive dithering the two assumptions always hold. Without dithering, the assumptions hold approximately for higher bitrates. However, for many practical scenarios the loss in performance due to not strict validity of these assumptions is negligible.

FIG. 1A schematically shows a time variant analogue signal (Amplitude vs time) and its digitization in samples, the samples being arranged in a number of time frames, each comprising a number $N_s$ of digital samples. FIG. 1A shows an analogue electric signal (solid graph), e.g. representing an acoustic input signal, e.g. from a microphone, which is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples y(n) at discrete points in time n, as indicated by the vertical lines extending from the time axis with solid dots at its endpoint coinciding with the graph, and representing its digital sample value at the corresponding distinct point in time n. Each (audio) sample y(n) represents the value of the acoustic signal at n (or $t_n$) expressed by a predefined number $N_b$ of bits, $N_b$ being e.g. in the range from 1 to 48 bit, e.g. 24 bits. Each audio sample is hence quantized using $N_b$ bits (resulting in $2^{Nb}$ different possible values of the audio sample).

The number of quantization bits $N_b$ used may differ depending on the application, e.g. within the same device. In a hearing device, e.g. a hearing aid, configured to establish a wireless communication link to another device (e.g. a contralateral hearing aid), the number of bits $N'_b$ used in the quantization of the signal to be transmitted may be smaller than the number of bits $N_b$ ($N'_b<N_b$) used in the normal processing of signals in a forward path of the hearing aid (to reduce the required bandwidth of the wireless communication link). The reduced number of bits $N'_b$ may be a result of a digital compression of a signal quantized with a larger number of bits ($N_b$) or a direct analogue to digital conversion using $N'_b$ bits in the quantization.

In an analogue to digital (AD) process, a digital sample y(n) has a length in time of $1/f_s$, e.g. 50 μs, for $f_s$=20 kHz. A number of (audio) samples $N_s$ are e.g. arranged in a time frame, as schematically illustrated in the lower part of FIG. 1A, where the individual (here uniformly spaced) samples are grouped in time frames (1, 2, . . . , $N_s$)). As also illustrated in the lower part of FIG. 1A, the time frames may be arranged consecutively to be non-overlapping (time frames 1, 2, . . . , m, . . . , M) or overlapping (here 50%, time frames 1, 2, . . . , m, . . . , M'), where m is time frame index. In an embodiment, a time frame comprises 64 audio data samples. Other frame lengths may be used depending on the practical application.

Figure 1B:
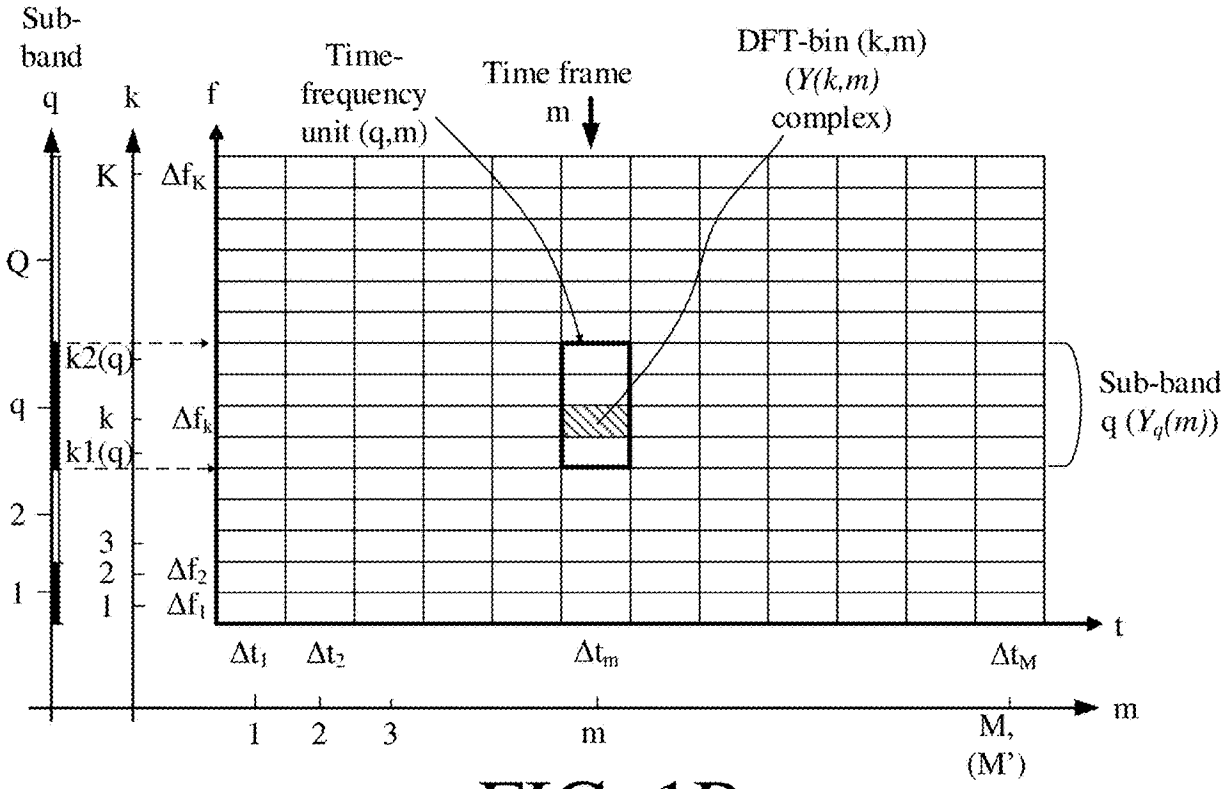
FIG. 1B illustrates a time-frequency map representation of the time variant electric signal of FIG. 1A, FIG. 1C schematically illustrates an exemplary digitization of an analogue signal to provide a digitized signal, thereby introducing a quantization error (resulting in quantization noise), and FIG. 1D schematically illustrates exemplary further quantization of an already digitized signal introducing further (typically larger) quantization errors, FIGS. 2A and 2B schematically illustrate a geometrical arrangement of a sound source relative to first and second embodiments of a binaural hearing aid system comprising first and second hearing devices when located at or in first (left) and second (right) ears, respectively, of a user.

FIG. 1B schematically illustrates a time-frequency representation of the (digitized) time variant electric signal y(n) of FIG. 1A. The time-frequency representation comprises an array or map of corresponding complex or real values of the signal in a particular time and frequency range. The time-frequency representation may e.g. be a result of a Fourier transformation converting the time variant input signal y(n) to a (time variant) signal Y(k,m) in the time-frequency domain. In an embodiment, the Fourier transformation comprises a discrete Fourier transform algorithm (DFT). The frequency range considered by a typical hearing aid (e.g. a hearing aid) from a minimum frequency $f_{min}$ to a maximum frequency $f_{max}$ comprises a part of the typical human audible frequency range from 20 Hz to 20 kHz, e.g. a part of the range from 20 Hz to 12 kHz. In FIG. 1B, the time-frequency representation Y(k,m) of signal y(n) comprises complex values (comprising magnitude and/or phase) of the signal in a number of DFT-bins (or tiles) defined by indices (k,m), where k=1, . . . , K represents a number K of frequency values (cf. vertical k-axis in FIG. 1B) and m=1, . . . , M (M') represents a number M (M') of time frames (cf. horizontal m-axis in FIG. 1B). A time frame is defined by a specific time index m and the corresponding K DFT-bins (cf. indication of Time frame m in FIG. 1B). A time frame m represents a frequency spectrum of signal y at time m. A DFT-bin or tile (k,m) comprising a (real) or complex value Y(k,m) of the signal in question is illustrated in FIG. 1B by hatching of the corresponding field in the time-frequency map. Each value of the frequency index k corresponds to a frequency range $\Delta f_k$, as indicated in FIG. 1B by the vertical frequency axis f. Each value of the time index m represents a time frame. The time $\Delta t_m$ spanned by consecutive time indices depend on the length of a time frame (e.g. 25 ms) and the degree of overlap between neighbouring time frames (cf. FIG. 1A and horizontal t-axis in FIG. 1B).

In the present application, a number Q of (potentially non-uniform, e.g. logarithmic) frequency sub-bands with sub-band indices q=1, 2, . . . , J are defined, each sub-band comprising one or more DFT-bins (cf. vertical Sub-band q-axis in FIG. 1 B). The $q^{th}$ sub-band (indicated by Sub-band q ($Y_q(m)$) in the right part of FIG. 1B) comprises DFT-bins (or tiles) with lower and upper indices k1(q) and k2(q), respectively, defining lower and upper cut-off frequencies of the $q^{th}$ sub-band, respectively. A specific time-frequency unit (q,m) is defined by a specific time index m and the DFT-bin indices k1(q)–k2(q), as indicated in FIG. 1B by the bold framing around the corresponding DFT-bins (or tiles). A specific time-frequency unit (q,m) contains complex or real values of the $q^{th}$ sub-band signal $Y_q(m)$ at time m. In an embodiment, the frequency sub-bands are third octave bands. $\omega_q$ denote a center frequency of the $q^{th}$ frequency band.

Figure 1C:
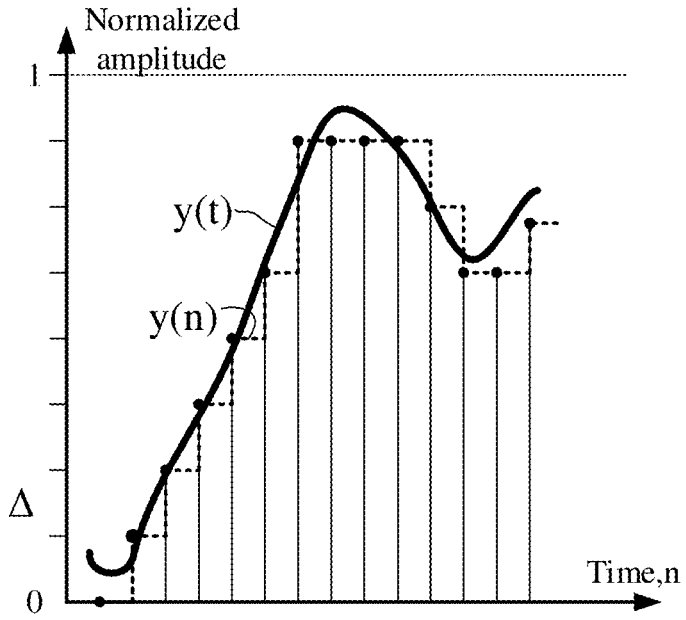

FIG. 1C schematically illustrates an exemplary digitization of a time variant analogue electric input signal y(t) to provide a digitized electric input signal y(n), thereby introducing a quantization error (resulting in quantization noise). The electric input signal is normalized to a value between 0 and 1 (Normalized amplitude) and is shown versus time (t or n). The quantization error may e.g. be indicated as the difference between the analogue electric input signal y(t) (bold line curve) and the digitized electric input signal y(n) (dotted step wise linear curve), y(t)–y(n). As is intuitively clear from FIG. 1C, the quantization error decreases with increasing number of quantization bits $N'_b$. In an embodiment, the number of quantization bits $N'_b$ is equal to three (resulting in $2^3$=8 steps), or more, e.g. equal to eight (resulting in $2^8$=256 steps), or more.

Figure 4A:
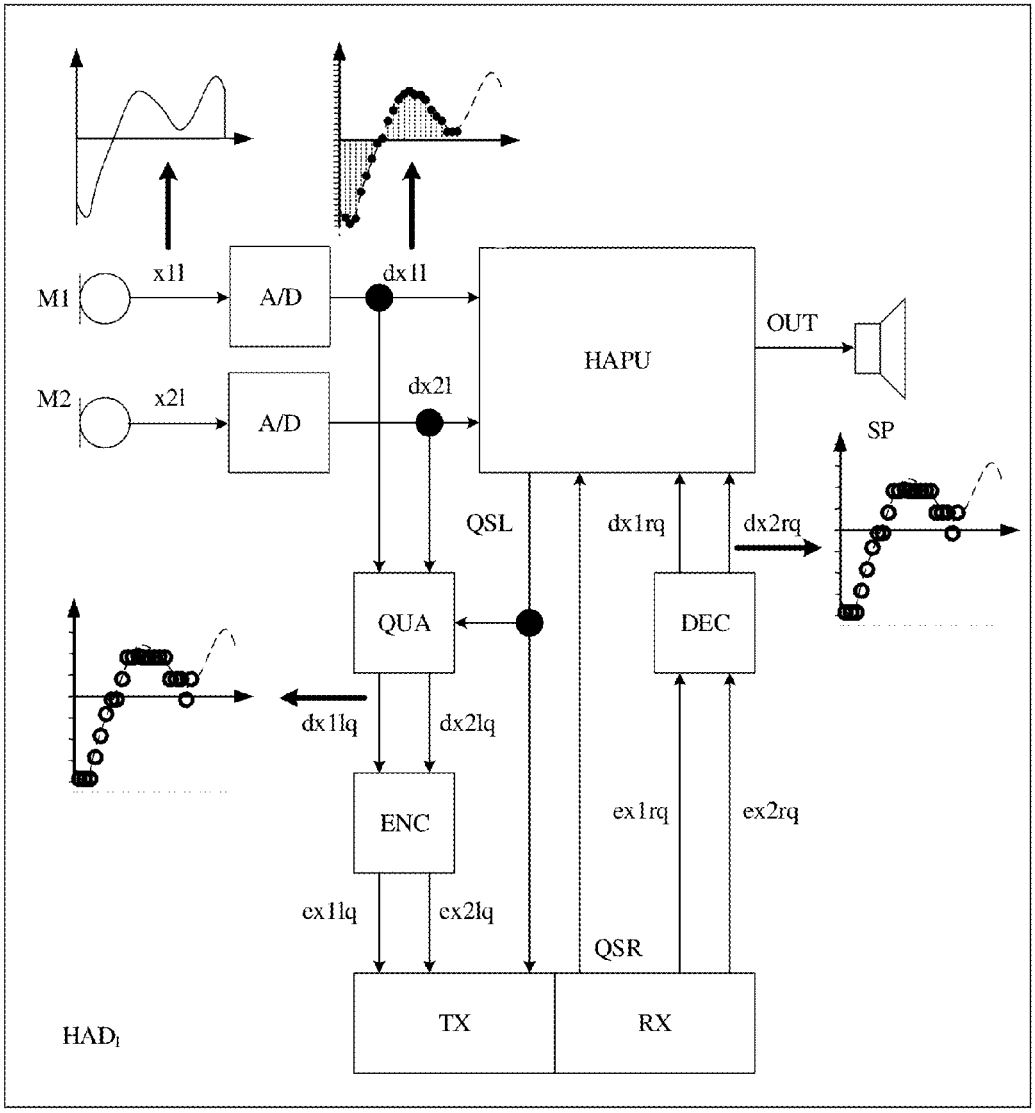
FIG. 4A shows a simplified block diagram of a hearing aid according to an embodiment of the present disclosure.

In an embodiment, the output of an analogue to digital converter, e.g. digitized with a sampling frequency of 20 kHz and a number of quantization bits $N_b$=24 is quantized to $N_b$=8 to reduce the necessary bandwidth of a wireless link for transmitting a signal of the forward path (e.g. an electric input signal from a microphone) to another device, e.g. to another hearing aid (cf. e.g. FIG. 4A). In an embodiment, the signal of the forward path may be down-sampled to further reduce the need for link bandwidth.

Figure 1D:
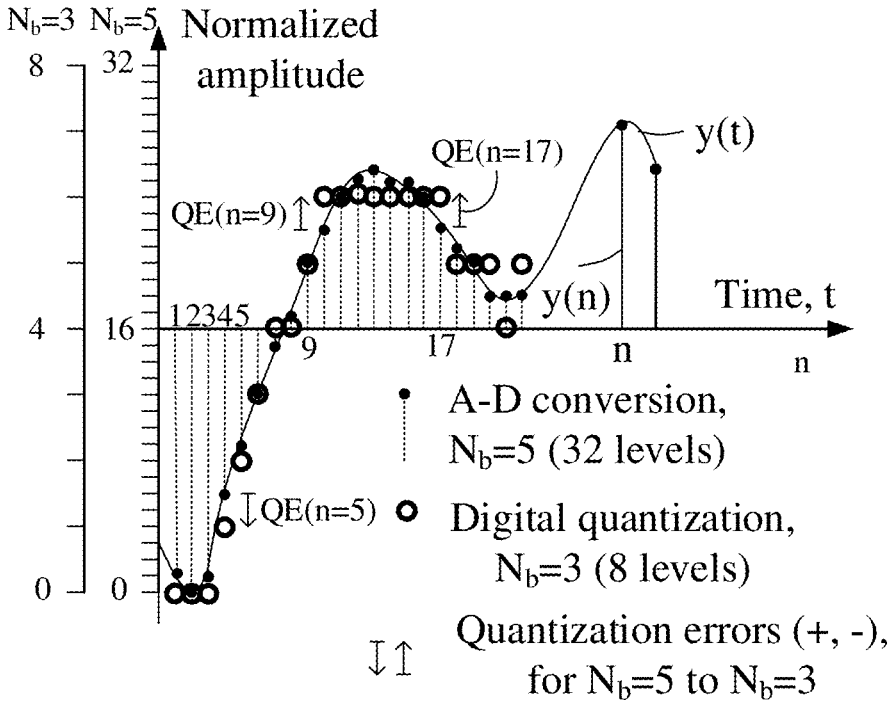

FIG. 1D schematically shows an example of a quantization of an already digitized signal. FIG. 1D schematically shows an amplitude versus time plot of an analogue signal y(t) (solid line), e.g. representing the electric input to an A/D converter (e.g. a microphone signal). The digitized signal y(n), n being a time index, provided by an A/D converter is shown as dotted line bars with small solid dots marking the value of the amplitude at a particular time index. The digitized signal after A/D-conversion is assumed to be quantized with $N_b$=5 bits ($2^5$=32 levels, far below typically used values, but chosen for illustrative purposes), cf. rightmost vertical axis of the 'Normalized amplitude' denoted '$N_b$=5'. An exemplary quantization of the digitized signal from the A/D converter is schematically illustrated by open dots, reflecting a quantization scheme with $N_b$=3 bits ($2^3$=8 levels, for illustrative purposes), cf. leftmost vertical axis of the 'Normalized amplitude' denoted '$N_b$=3'. Knowing the (digital) values of the signal from the A/D converter and the (digital) values of the quantized signal for a given quantization scheme, the quantization errors introduced by conversion are known. The quantization errors (QE) are indicated in FIG. 1D for time instances n=5, 9 and 17 in FIG. 1D by up and downward pointing arrows denoted QE(n), downward and upward pointing arrows indicating a negative and positive quantization error, respectively. A downward and upward pointing arrow is taken to indicate that the value of the quantized signal is smaller and larger, respectively, than the value of the signal before quantization (here of the signal from the A/D converter). In the schematic illustration of FIG. 1D, it is assumed that the 'sampling rate' (index n) is identical before and after quantization. This need not be the case, however. A lower sampling rate may further reduce the need for link-bandwidth. In general, the sampling rate may be adapted to the frequency content of the electric input signal. If e.g. it is expected that all frequencies are below a certain frequency lower than a normal maximum frequency of operation, the quantized signal may be correspondingly down-sampled. For a given quantization scheme, a predefined statistical distribution of the quantization error can be assumed. For example, for a mid-tread quantizer, the variance $\sigma_q^2$ is known as a number of bits $N_b$ in the quantization (defining a step size Δ of the scheme). Hence, an inter-microphone noise covariance matrix $\overline{C}_q$ representing the quantization error for the hearing aid system (microphone configuration) in question can be determined in advance of use of the system, and made accessible to the respective hearing aids during use. The acoustic noise covariance matrix $\overline{C}_v$ may be based on a priori (assumed) knowledge about the acoustic operating environment of the beamformer (hearing device). For example, if it is assumed that the hearing device will mainly be operating in isotropic noise fields, the noise covariance matrices (one for each frequency, k) may be determined based on this knowledge, e.g. in advance of normal use of the hearing device (e.g. except a scaling factor λ, which may be dynamically estimated for a given acoustic environment during normal use). A resulting noise covariance matrix can hence be determined as $\overline{C}_e=\overline{C}_v+\overline{C}_q$, where $\overline{C}_v$ is the noise covariance matrix for the acoustic (e.g. isotropic) noise in the environment. Thereby an optimal beamformer (e.g. optimal beamformer filtering coefficients w(km)) that takes into account (include) the quantization noise in the (exchanged) microphone signals can be determined.

Quantization and Dithering:

For simplicity, we assume that the data compression scheme is simply given by a uniform $N'_b$-bit quantizer. In an embodiment, the data may already be quantized at a relatively high rate (e.g. $N_b$=16 bits or more) in a forward path of a hearing aid. The symmetric uniform quantizer maps the actual range of the signal, $x_{min} \le x \le x_{max}$, to the quantized range $x_{min} \le \hat{x}\ x_{max}$, where $x_{max}=-x_{min}$. The quantized value $\hat{x}$ can take one out of $K'=2^{N'b}$ different discrete levels (cf. FIG. 1C).

The amplitude range is subdivided into $K'=2^{N'b}$ uniform intervals of width $\Delta=(2x_{max})/2^{N'b}$, where $x_{max}$ is the maximum value of the signal to be quantized. A well-known quantizer is the mid-tread quantizer with a staircase mapping function f(x), defined as $$f(x) = \hat{x} = \Delta\left\lfloor \frac{x}{\Delta} + \frac{1}{2} \right\rfloor,$$

where $\lfloor \cdot \rfloor$ is the "floor" operation. The quantization error QN may e.g. be denoted by $e=\hat{x}-x$, and is determined by the value of the stepsize $\Delta$. Under certain conditions, e has a uniform distribution, that is, $$p(e)=\Delta^{-1}, \text{ for } -\Delta/2 \le e \le \Delta/2, \text{ and}$$

$$p(e)=0, \text{ otherwise},$$

with variance $\sigma^2=\Delta^2/12$. One of the conditions when this happens, is when the characteristic function (CF), which is the Fourier transform of a probability density function, of the variable that is quantized is band-limited. In that case, the QN is uniform. However, the characteristic functions of many random variables are not band-limited (e.g., consider the Gaussian random variable). A less strict condition is that the characteristic function has zeros at frequencies $k\Delta^1$, for all k except for k=0. Alternatively, subtractive dithering can be applied, which can be used to guarantee that one of the above conditions is met.

In a subtractively dithered topology, the quantizer input is comprised of a quantization system input x plus an additive random signal (e.g. uniformly distributed), called the dither signal, denoted by v which is assumed to be stationary and statistically independent of the signal to be quantized [Lipshitz et al., 1992]. The dither signal is added prior to quantization and subtracted after quantization (at the receiver). For the exact requirements on the dither signal and the consequences on the dithering process, see [Lipshitz et al., 1992]. In fact, subtractive dither assumes that the same noise process v can be generated at the transmitter and receiver and guarantees a uniform QN e that is independent of the quantizer input.

Quantization Aware Beamforming:

In prior art solutions, it has often been assumed that the received signals at the microphones in one hearing aid of a binaural hearing aid system are transmitted without error to the contralateral side and vice versa. This is not the case in practice. In order to take into account of the QN in a beamforming task, we introduce new noisy signals representing the quantization noise.

The beamformer filtering weights are functions of a look vector d of dimension M (where M is the number of microphones) and of a noise covariance matrix $C_v$, which is an M×M matrix, see e.g. EP2701145A1.

The concept of quantization aware beamforming is further described by the present inventors in [Amini et al., 2016], which is referred to for further details.

Figure 2A:
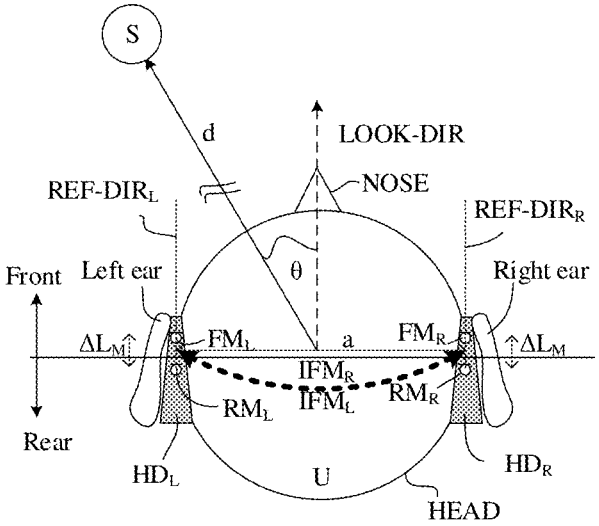
Figure 2B:
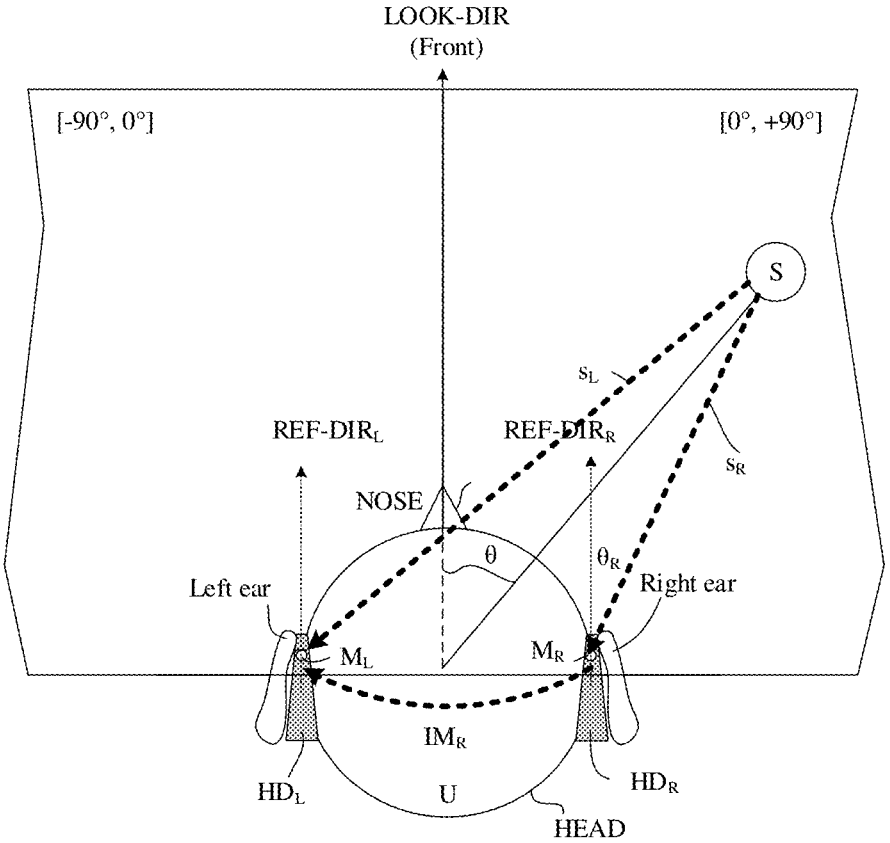

FIGS. 2A and 2B schematically illustrate respective geometrical arrangements of a sound source relative to first and second embodiments of a binaural hearing aid system comprising first and second hearing devices when located at or in first (left) and second (right) ears, respectively, of a user.

FIG. 2A schematically illustrates a geometrical arrangement of sound source relative to a hearing aid system comprising left and right hearing devices ($HD_L$, $HD_R$) when located on the head (HEAD) at or in left (Left ear) and right (Right ear) ears, respectively, of a user (U). Front and rear directions and front and rear half planes of space (cf. arrows Front and Rear) are defined relative to the user (U) and determined by the look direction (LOOK-DIR, dashed arrow) of the user (here defined by the user's nose (NOSE)) and a (vertical) reference plane through the user's ears (solid line perpendicular to the look direction (LOOK-DIR)). The left and right hearing devices ($HD_L$, $HD_R$) each comprise a BTE-part located at or behind-the-ear (BTE) of the user. In the example of FIG. 1B, each BTE-part comprises two microphones, a front located microphone ($FM_L$, $FM_R$) and a rear located microphone ($RM_L$, $RM_R$) of the left and right hearing devices, respectively. The front and rear microphones on each BTE-part are spaced a distance $\Delta L_M$ apart along a line (substantially) parallel to the look direction (LOOK-DIR), see dotted lines REF-$DIR_L$ and REF-$DIR_R$, respectively. A target sound source S is located at a distance d from the user and having a direction-of-arrival defined (in a horizontal plane) by angle θ relative to a reference direction, here a look direction (LOOK-DIR) of the user. In an embodiment, the user U is located in the far field of the sound source S (as indicated by broken solid line d). The two sets of microphones ($FM_L$, $RM_L$), ($FM_R$, $RM_R$) are spaced a distance a apart.

Microphone signals ($IFM_L$, $IFM_R$) from the front microphones ($FM_L$, $FM_R$) are exchanged between the left and right hearing devices via a wireless link. The microphones signals comprise quantization noise. Each of the hearing devices comprises a binaural beamformer filtering unit arranged to get the two local microphone inputs from the respective front and rear microphones (assumed to comprise essentially no quantization noise) and one microphone input (comprising quantization noise) received from the contralateral hearing device via the wireless communication link.

FIG. 2B illustrates a second embodiment of a binaural hearing aid system according to the present disclosure. The setup is similar to the one described above in connection with FIG. 2A. The only difference is that the left and right hearing devices HDL, HDR each contain a single input transducer (e.g. microphone) FML and FMR, respectively. At least the microphone signal $IM_R$ (comprising quantization noise) is transmitted from the right to the left hearing device and used there in a binaural beamformer.

A direction from the target sound source to the left and right hearing devises is indicated (a direction of arrival DOA may thus be defined by the angle θ).

Figure 3:
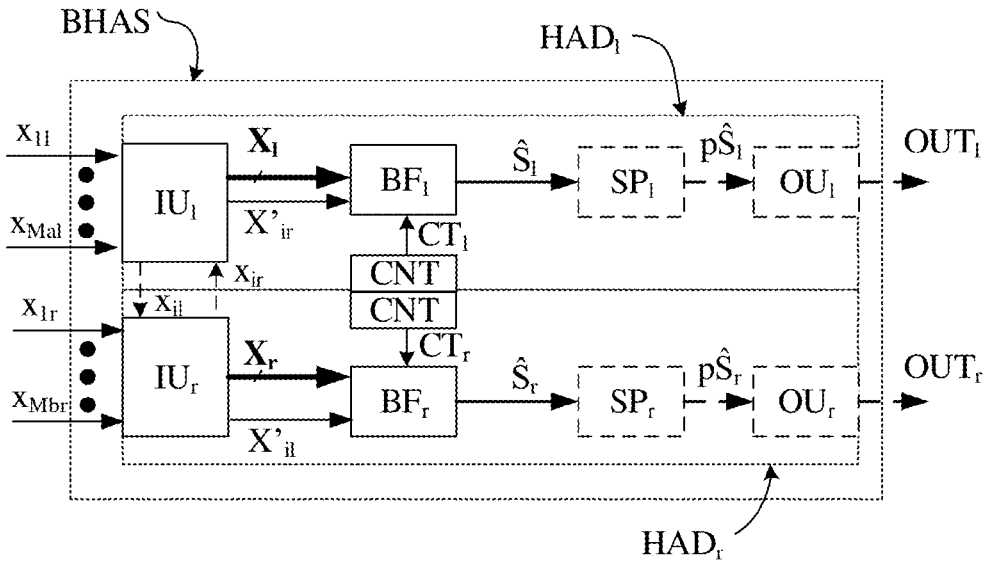
FIG. 3 shows an embodiment of a binaural hearing aid system according to the present disclosure.

FIG. 3 shows an embodiment of a binaural hearing aid system (BHAS) comprising left ($HAD_l$) and right ($HAD_r$) hearing assistance devices adapted for being located at or in left and right ears, respectively, of a user, or adapted for being fully or partially implanted in the head of the user. The binaural hearing assistance system (BHAS) further comprises a communication link configured to communicate quantized audio signals between the left and right hearing assistance devices thereby allowing binaural beamforming in the left and right hearing assistance devices.

The solid-line blocks (input units $IU_l$, $IU_r$, beamformer filtering units $BF_l$, $BF_r$, control units CNT, and the wireless communication link) constitute the basic elements of the hearing assistance system (BHAS) according to the present disclosure. Each of the left ($HAD_l$) and right ($HAD_r$) hearing assistance devices comprises a multitude of input units $IU_i$, i=1, . . . , M, M being larger than or equal to two. The respective input units $IU_l$, $IU_r$ provide a time-frequency representation $X_i(k,m)$ (signals $X_l$ and $X_r$, each representing M signals of the left and right hearing assistance devices, respectively) of an input signal $x_i(n)$ (signals $x_{1l}, \ldots, x_{Mal}$ and $x_{1r}, \ldots, x_{Mbr}$, respectively), at an $i^{th}$ input unit in a number of frequency bands and a number of time instances, k being a frequency band index, m being a time index, n representing time. The number of input units of each of the left and right hearing assistance devices is assumed to be M, e.g. equal to 2. Alternatively, the number of input units of the two devices may be different. As indicated in FIG. 3 by dashed arrows denoted $x_{il}$, $x_{ir}$ one or more quantized microphone signals are transmitted from the left to the right and from the right to the left hearing assistance device, respectively. The signals $x_{il}$, $x_{ir}$ each representing one or more microphone signals picked up by a device at one ear and communicated to the device at the other ear are used as input to the respective beamformer filtering units ($BF_l$, $BF_r$) of the hearing device in question, cf. signals $X'_{ir}$ and $X'_{il}$ in the left and right hearing devices, respectively. The communication of signals between the devices may in principle be via a wired connection but is here assumed to be via a wireless link, and implemented via appropriate antenna and transceiver circuitry. The time dependent inputs signals $x_i(n)$ and the time-frequency representation $X_i(k,m)$ of the $i^{th}$ input signal (i=1, . . . , M) comprises a target signal component and an acoustic noise signal component, the target signal component originating from a target signal source. The wirelessly exchanged microphone signals $x_{ir}$ and $x_{il}$ are also assumed to comprise respective target and acoustic noise signal components, and additionally a quantization noise component (originating from a quantization of the microphone signals that are exchanged via the wireless link).

Each of the left ($HAD_l$) and right ($HAD_r$) hearing assistance devices comprises a beamformer filtering unit ($BF_l$, $BF_r$) operationally coupled to said multitude of input units $IU_i$, i=1, . . . , M, ($IU_l$ and $IU_r$) of the left and right hearing assistance devices and configured to provide a (resulting) beamformed signal $\hat{S}(k,m)$, ($\hat{S}_l$, $\hat{S}_r$ in FIG. 3), wherein signal components from other directions than a direction of a target signal source are attenuated, whereas signal components from the direction of the target signal source are left unattenuated or attenuated less than signal components from said other directions.

The dashed-line blocks of FIG. 3 (signal processing units $SP_l$, $SP_r$ and output units $OU_l$, $OU_r$) represent optional further functions forming part of an embodiment of the hearing assistance system (BHAS). The signal processing units ($SP_l$, $SP_r$) may e.g. provide further processing of the beamformed signal ($\hat{S}_l$, $\hat{S}_r$), e.g. applying a (time-/level-, and/or) frequency dependent gain according to the needs of the user (e.g. to compensate for a hearing impairment of the user) and may provide a processed output signal ($p\hat{S}_l$, $p\hat{S}_r$). The output units ($OU_l$, $OU_r$) are preferably adapted to provide a resulting electric signal (e.g. respective processed output signal ($p\hat{S}_l$, $p\hat{S}_r$)) of the forward path of the left and right hearing assistance devices as stimuli perceivable to the user as sound representing the resulting electric (audio signal) of the forward path (cf. signals $OUT_l$, $OUT_r$).

The beamformer filtering units are adapted to receive at least one local electric input signal and at least one quantized electric input signal from the contralateral hearing device. The beamformer filtering units are configured to determine beamformer filtering weights (e.g. MVDR filtering weights), which, when applied to said first electric input signal and said quantized electric input signal, provide the respective beamformed signals. The respective control units are adapted to control the beamformer filtering units taking account of the quantization noise based on knowledge of the specific quantization scheme (via respective control signals $CNT_l$ and $CNT_r$). The beamformer filtering weights are determined depending on a look vector and a (resulting) noise covariance matrix, wherein the total noise covariance matrix $\overline{C}_e$ comprises an acoustic component $\overline{C}_v$ and a quantization component $\overline{C}_q$.

$$\overline{C}_e=\overline{C}_v+\overline{C}_q$$

where $\overline{C}_v$ is a contribution from acoustic noise, and $\overline{C}_q$ is a contribution from the quantization error. The quantization component $\overline{C}_q$ is a function of the applied quantization scheme (e.g. a uniform quantization scheme, such as a mid-riser or a mid-tread quantization scheme, with a specific mapping function), which should be agreed on, e.g. exchanged between devices (or fixed). In an embodiment, a number of quantization schemes, and their corresponding characteristic distribution and variance, are stored in or otherwise accessible to the hearing aid(s). In an embodiment, the quantization scheme is selectable from a user interface, or automatically derived from the current electric input signal(s), and or from one or more sensor inputs (e.g. relating to the acoustic environment, or to properties of the wireless link, e.g. a current link quality). The quantization scheme is e.g. chosen with a view to the available bandwidth of the wireless link (e.g. the currently available bandwidth), and/or to a current link quality.

If e.g. a mid-tread quantizer is chosen, the variance can (as indicated above) be expressed as $\sigma^2=\Delta^2/12$, where $\Delta$ is a step-size in the quantization, and thus a function of the number of bits $N_b$ used in the quantization (for a given number of bits $N_b'$ in the quantization, the step-size $\Delta$, and thus the variance $\sigma^2$ is known). For a three microphone configuration, where one microphone signal is exchanged between two hearing aids (and two are provided locally), a noise covariance matrix for the quantization component $\overline{C}_q$ would be $$\overline{\overline{C}}_q=\begin{bmatrix}0&0&0\\0&0&0\\0&0&\sigma_q^2\end{bmatrix}$$

Where $$\sigma_q^2=\frac{\Delta_q^2}{12},$$

and $\Delta_q$ is the step-size for the particular mid-tread quantization agreed on. In case the acoustic noise covariance matrix $\overline{C}_v$ is known (or measured), the noise being e.g. assumed to be isotropic, the (resulting) noise covariance matrix $\overline{C}_e$ can thus be determined for the given quantization scheme q.

The resulting beamformer filtering weights for the left and right hearing aids $HAD_l$, $HAD_r$ (taking the quantization noise into consideration) can be expressed as:

$$\underline{w}_x=\frac{\overline{C}_e^{-1}\underline{d}_x}{\underline{d}_x^H\overline{C}_e^{-1}\underline{d}_x}$$

where x=l, r, and $d_x$ represents a look vector for the beamformer filtering unit of left (x=l) or right (x=r) hearing aid. The look vector $\underline{d}_x$ is a M'x1 vector that contains a transfer function of sound from the target sound source to the microphones of the left and right hearing aids whose electric signals are considered by the beamformer filtering unit in question (in the example of FIG. 3 M'=Mal+Mbr (the sum of the number (Mal, Mbl) of microphones of the left and right hearing aids ($HAD_l$, $HAD_r$), respectively; in the example of FIG. 4A, 4B, M'=2+2=4). Alternatively, the look vector $\underline{d}_x$ comprises relative transfer functions (RTF), i.e. acoustic transfer functions from a target signal source to any microphone in the hearing aid system relative to a reference microphone (among said microphones).

FIG. 4A shows a hearing device ($HAD_l$), e.g. a hearing aid, adapted for being located at or in a first ear of a user, or to be fully or partially implanted in the head at a first ear of a user. Here a hearing aid for a left ear is shown (cf. indication 'l' in $HAD_l$ of the hearing aid, and 'l' in signal names x1*l*, x2*l*, etc.), but it might as well be for a right ear. The hearing device comprises first and second input transducers (here embodied in microphones M1, M2) for converting sound around the user wearing the hearing aid at a location of the first and second input transducers, respectively, to first and second (analogue) electric input signals, x1*l* and x2*l*, respectively (cf. exemplary sketch of an analogue signal representing sound (continuous solid curve) above the first microphone path (x1*l*)). The sound field around the user is assumed—at least for some time segments—to comprise a mixture of a target sound from a target sound source and possible acoustic noise. The hearing aid further comprises a receiver configured to receive a first quantized electric input signal via a communication link (e.g. a communication link to/from another, e.g. contralateral, hearing aid, $HAD_r$, not shown in FIG. 4A). The hearing aid comprises first and second analogue to digital converters (A/D) connected to the first and second microphones (M1, M2), respectively, providing first and second digitized electric input signals (dx1*l*, dx2*l*), respectively (cf. exemplary sketch of a digitized version of the analogue signal (represented by solid dots) above the first signal path (dx1*l*)). The first and second electric input signals are e.g. sampled with a frequency in the range of 20 kHz-25 kHz or more. Each audio sample is e.g. quantized in values represented by $N_b$=24 bits (or more). Thereby a small (and negligible) quantization error (difference between the analogue value and digitized value of a given sample) is introduced in the first and second digitized electric input signals (dx1*l*, dx2*l* ). Additionally, each digitized electric input signal may be split into sub-band signals by a filter bank, thereby providing the signals in a time frequency representation (k,m). The sub-band filtering may take place in connection with the A/D-conversion or in the signal processor (HAPU), or elsewhere, as appropriate. In such case the processing of the forward path, e.g. the beamforming may be performed in the time-frequency domain. The first and second digitized electric input signals (dx1*l*, dx2*l*), which are quantized and transmitted to the other hearing aid ($HAD_r$), and the first and second quantized electric signals (dx1*rq*, dx2*rq*), which are received from the other hearing aid ($HAD_r$), respectively, via the communication link may be a digitized signal in the time domain or represented by a number of digitized sub-band signals, each representing quantized signals in a time-frequency representation. The sub-band signals may be represented by complex parts (magnitude and phase) that are quantized individually, or alternatively using vector quantization (VQ).

The first and second digitized electric input signals (dx1*l*, dx2*l*) are fed to a signal processor (HAPU), e.g. comprising a multi-input beamformer filtering unit (cf. e.g. FIG. 3). In preparation for being transmitted to another device, at least one of the first and second digitized electric input signals (dx1*l*, dx2*l*) (here both) are also fed to quantization unit (QUA) for being quantized with a smaller number of bits $N_b'$ than used in the AD-conversion (e.g. $N_b'$=8 instead of $N_b$=24) to thereby save bandwidth in the wireless link. The quantization unit (QUA) provides first and second quantized digitized electric input signals (dx1*lq*, dx2*lq*) (cf. exemplary sketch of a further quantized version of the digitized signal (represented by open circles) to the left of the first signal path (dx1*lq*)). This quantization has the disadvantage of introducing non-negligible quantization errors (termed 'quantization noise') in the transmitted (or received) 'microphone signals'. As e.g. discussed in connection with FIG. 1D, this quantization error is known for a given quantization scheme (e.g. 24 to 8 bit quantization). The quantization scheme is e.g. fixed or configurable via signal QSL from the signal processor to the (possibly configurable) quantization unit (QUA). Information about the quantization scheme (e.g. $N_b$->$N_b'$), cf. signal QSL is e.g. transmitted to the other device in advance of or together with the quantized, and possibly encoded (cf. encoder ENC), microphone signal(s), cf. signals (dx1*lq*, dx2*lq*) and (ex1*lq*, ex2*lq*), respectively, to allow the other device to account for the quantization in the microphone signals transmitted to and received in the other device. The encoder (ENC) applies a specific audio coding algorithm to the quantized signals (dx1*lq*, dx2*lq*), and provides corresponding encoded signals (ex1*lq*, ex2*lq*) that are fed to transmitter (TX) for transmission to the other device, e.g. a contralateral hearing aid ($HAD_r$) of a binaural hearing aid system (cf. e.g. FIG. 3), or to a separate processing device, e.g. a smartphone. The chosen audio coding algorithm, e.g. G722, SBC, MP3, MPEG-4, etc., or proprietary (non-standard) schemes, may provide lossless or lossy compression of the input signal to further reduce the necessary bandwidth of the wireless link. In case the audio coding scheme is configurable, the selected scheme should be transferred to the other device (e.g. via signal QSL). Likewise, in case the sampling rate is changed in the quantization process, such information should also be transferred to the other device.

Similarly, the (left) hearing aid ($HAD_l$) of FIG. 4A is configured to receive one or more audio signals from another device, e.g. from a contralateral hearing aid ($HAD_r$) of a binaural hearing aid system (cf. e.g. FIG. 3), or from a separate processing device, e.g. a wireless microphone, or a smartphone. The hearing aid ($HAD_l$) comprises a receiver RX for wirelessly receiving and demodulating the one or more audio signals and provide corresponding (e.g. encoded) electric signals (dx1*rq*, dx2*rq*). Additionally, the hearing aid ($HAD_l$) is configured to receive information about a quantization scheme (e.g. $N_b$->$N_b'$) to which the received audio signals have been subject, cf. signal QSR, which is fed to the processing unit HAPU. The hearing aid ($HAD_l$) comprises an audio decoder for decoding the encoded electric signals (ex1*rq*, ex2*rq*) to provided decoded quantized signals (dx1*rq*, dx2*rq*) (cf. exemplary sketch of a quantized version of the digitized signal (represented by open circles) to the right of the second signal path (dx2*rq*)).

The (left) hearing aid ($HAD_l$) of FIG. 4A comprises an output unit, e.g. an output transducer, here a loudspeaker (SP), for converting a processed electric signal OUT from the signal processor (HAPU) to stimuli (here acoustic stimuli) perceivable for a user as sound. The output unit may comprise a synthesis filter for converting frequency sub-band signals to a resulting time-domain signal, if appropriate.

Figure 4B:
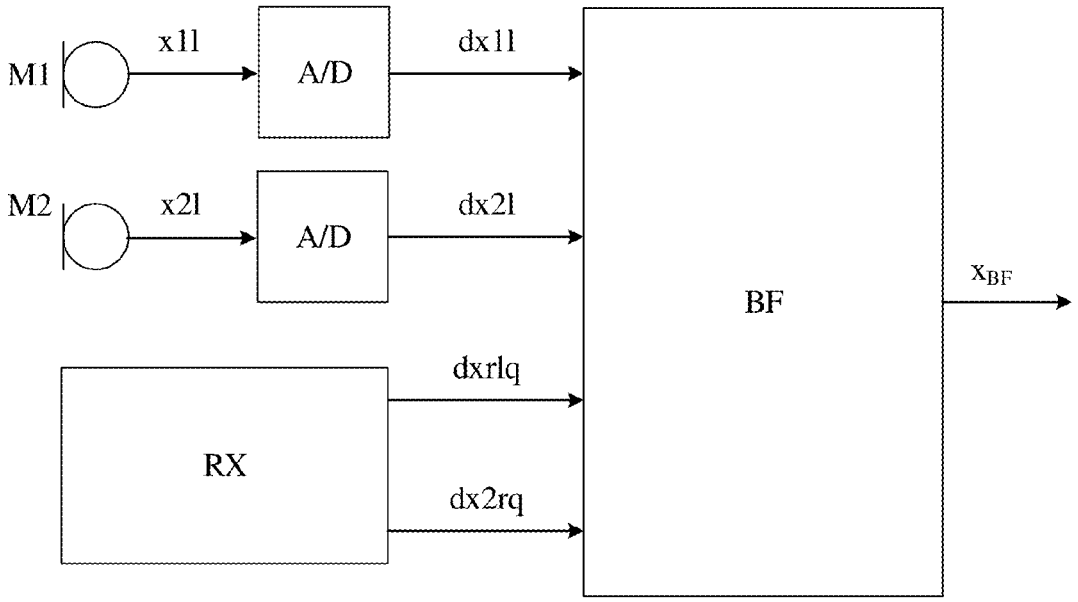
FIG. 4B illustrates the audio signal inputs and output of an exemplary beamformer filtering unit forming part of the signal processor of FIG. 4A.

The signal processor (HAPU) comprises a multi-input beamformer filtering unit (cf. e.g. FIG. 3, and FIG. 4B)

adapted to receive the first and second digitized electric input signals (dx1*l*, dx2*l*) of local origin, the first and second quantized electric input signals (dx1*rq*, dx2*rq*) received from the other device, and to determine beamformer filtering weights, which, when applied to the first electric input signals and the quantized electric input signals, provide a beamformed signal, $x_{BF}$, cf. FIG. 4B. The signal processor (HAPU) typically comprises further processing algorithms for further enhancing the spatially filtered signal $x_{BF}$, e.g. for providing further noise reduction, compressive amplification, frequency transposition, decorrelation of output and input, etc., to provide a resulting processed signal OUT for presentation to the user (and or transmission to another device for analysis and/or further processing there).

FIG. 4B illustrates the audio signal inputs and output of an exemplary beamformer filtering unit (BF) forming part of the signal processor of FIG. 4A. The beamformer filtering unit (BF) provides a beamformed signal $x_{BF}$ by application of appropriate beamformer filtering weights w to the input signals, here the first and second digitized electric input signals (dx1*l*, dx2*l*) of local origin, the first and second quantized electric input signals (dx1*rq*, dx2*rq*) received from the other device. The first and second (noisy) digitized signals dx1*l*, dx2*l* of the left hearing aid $HAD_l$ (and dx1*r*, dx2*r* of a right hearing aid $HAD_r$) each (at least in certain time segments) comprises a target signal component s and an acoustic noise component v. The first and second quantized electric input signals comprises a part (e.g. represented by noise covariance matrix $\overline{C}_v$) originating from the noisy acoustic signal ('s+v') and a part (e.g. represented by noise covariance matrix $\overline{C}_q$) originating from the electric quantization error (qn, where the quantization error in the first and second electric input signals originating from the A/D-conversion is ignored (negligible)). In the example of FIG. 4A, 4B the noise covariance matrix $\overline{C}_q$ for the quantization noise would be a 4×4 matrix:

$$\overline{\overline{C}}_q = \begin{bmatrix} 0 & \dots & 0 \\ \vdots & \sigma_{1q}^2 & \vdots \\ 0 & \dots & \sigma_{2q}^2 \end{bmatrix}$$

where the two non-zero diagonal matrix elements ($\sigma_{1q}^2$, $\sigma_{2q}^2$) represent the respective variances of the quantization schemes applied to the first and second (noisy) digitized signals (dx1*l*, dx2*l*) of the left hearing aid $HAD_l$ (and optionally to signals (dx1*r*, dx2*r*) received from a right hearing aid $HAD_r$). In case the same quantization scheme is applied to both signals, the two elements are equal ($\sigma_{1q}^2=\sigma_{2q}^2$).

In the example of FIG. 4A, 4B, the first and second quantized electric input signals originate from a right hearing aid ($HAD_r$):

$$dx1rq=dx1r+qn1r$$

$$dx2rq=dx2r+qn2r$$

For a given quantization scheme, the statistical properties of the quantization noise are known (and relevant parameters are available in the hearing aid in question), and the relevant quantization noise covariance matrix $\overline{C}_q$, and hence the optimized beamformer filtering weights $\underline{w}(k,m)$ (in general M×1 vector, here a 4×1 vector) can be determined as indicated above. The resulting beamformed signal $x_{BF}$ for the left hearing aid ($HAD_l$) can then be determined as $$x_{BF}(k,m)=\underline{w}_l^H(k,m)x_l(k,m)$$

where $x_l(k,m)=(dx1l(k,m), dx2l(k,m), dx1rq(k,m), dx2rq(k,m))^H$, where k and m are frequency and time indices, respectively, and H denotes Hermitian transposition. In the example of FIG. 4A, 4B, $\underline{w}_l^H(k, m)$ is a 1×4 vector and $x_l(k, m)$ is a 4×1 vector, providing $x_{BF}(k,m)$ as a single value (for each time-frequency tile or unit). The resulting beamformed signal $x_{BF}$ for a right hearing aid ($HAD_r$) can be determined in a corresponding manner. In this case the quantization error is present in the microphone signals (dx1*lq*, dx2*lq*) received from the left hearing aid ($HAD_l$).

Thereby the quantization noise is taken account of to provide an optimized beamformer. Neglecting the quantization noise would lead to a sub-optimal beamformer.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Haykin & Liu, 2010] S. Haykin and K. J. R. Liu, "Handbook on array processing and sensor networks," pp. 269-302, 2010.

[Srinivasan et al., 2008] S. Srinivasan, A. Pandharipande, and K. Janse, "Beamforming under quantization errors in wireless binaural hearing aids," EURASIP Journal on Audio, Speech, and Music Processing, vol. 2008, no. 1, pp. 1-8, 2008.

[Lipshitz et al., 1992] S. P. Lipshitz, R. A. Wannamaker, and J. Vanderkooy, "Quantization and dither: A theoretical survey," Audio Eng. Soc., vol. 40, pp. 355-375, 1992.

[Amini et al., 2016] Jamal Amini, Richard C. Hendriks, Richard Heusdens, Meng Guo, and Jesper Jensen, "On the Impact of Quantization on Binaural MVDR Beamforming", Speech Communication; 12. ITG Symposium; Proceedings of, Paderborn, Germany, 5-7 Oct. 2016, Publication Year: 2016, Page(s):1-5, ISBN: 978-3-8007-4275-2 .

EP2701145A1

The invention claimed is:

1. A hearing device adapted for being located at or in a first ear of a user, or to be fully or partially implanted in the head at a first ear of a user, the hearing device comprising a first input transducer for converting a first input sound signal from a sound field around the user at a first location, the first location being a location of the first input transducer, to a first electric input signal, the sound field comprising a mixture of a target sound from a target sound source and possible acoustic noise;

a transceiver configured to receive a first quantized electric input signal via a communication link, the first quantized electric input signal being representative of the sound field around the user at a second location, the first quantized electric input signal comprising quantization noise due to a specific quantization scheme;

a beamformer filter adapted to receive said first electric input signal and said first quantized electric input signal and to determine beamformer filtering weights, which, when applied to said first electric input signal and said first quantized electric input signal, provide a beamformed signal, and a controller adapted to control the beamformer filter in dependence of said quantization noise, to provide that said beamformer filtering weights are determined depending on a look vector and a noise covariance matrix, wherein the noise covariance matrix comprises an acoustic component and a quantization component.

2. A hearing device according to claim 1, wherein said controller is configured to control the beamformer filter based on the specific quantization scheme.

3. A hearing device according to claim 1 wherein the beamformer filter is a minimum variance distortionless response (MVDR) beamformer.

4. A hearing device according to claim 1 constituting or comprising a hearing aid, a headset, an earphone, an ear protection device or a combination thereof.

5. A hearing device according to claim 1 comprising a memory unit comprising a number of different possible quantization schemes, and wherein the controller is configured to select the specific quantization scheme among said number of different quantization schemes.

6. A hearing device according to claim 5, wherein the controller is configured to select the quantization scheme in dependence of one or more of the input signal, a battery status, and an available link bandwidth.

7. A hearing device according to claim 1 wherein the controller is configured to receive information about said specific quantization scheme from another device.

8. A hearing device according to claim 7 wherein said information about said specific quantization scheme comprises its distribution, and/or variance, and/or elements of a covariance matrix.

9. A hearing device according to claim 5 wherein said number of different possible quantization schemes comprises a mid-tread and/or a mid-rise quantization scheme.

10. A hearing device according to claim 1 wherein said transceiver comprises antenna and transceiver circuitry configured to establish a wireless communication link to/from another device, e.g. another hearing device, to allow the exchange of quantized electric input signals and information of said specific quantization scheme with said other device via said wireless communication link.

11. A hearing device according to claim 1 wherein said first quantized electric input signal received via the communication link is a digitized signal in the time domain or a number of digitized sub-band signals, each representing quantized signals in a time-frequency representation.

12. A hearing device according to claim 1 comprising a time-frequency converter for providing a time-frequency representation of the electric input signal.

13. A hearing device according to claim 1 wherein said noise covariance matrix $\overline{C}_e$ comprises an acoustic component $\overline{C}_v$ and a quantization component $\overline{C}_q$, $\overline{C}_e=\overline{C}_v+\overline{C}_q$, where $\overline{C}_v$ is a contribution from acoustic noise, and $\overline{C}_q$ is a contribution from the quantization error, and wherein the quantization component $\overline{C}_q$ is a known function of the applied quantization scheme and wherein the noise covariance matrix of the acoustic part $\overline{C}_v$ is known in advance, at least except a scaling factor $\lambda$.

14. A hearing device according to claim 13 wherein said scaling factor $\lambda$ is determined during use of the hearing device.

15. A hearing device according to claim 1 comprising first and second input transducers for converting respective first and second input sound signals from said sound field around the user to first and second digitized electric input signals, respectively, and configured to quantize at least one of said first and second digitized electric input signals to at least one quantized electric signal and to transmit said quantized electric signal to another device via said communication link.

16. A binaural hearing system comprising first and second hearing devices according to claim 1.

17. A binaural hearing system according to claim 16 comprising an auxiliary device wherein the system is adapted to establish a communication link between the hearing first and second devices and the auxiliary device to provide that information can be exchanged or forwarded from one to the other.

* * * * *